US008152570B2

(12) United States Patent
Kim et al.

(10) Patent No.: US 8,152,570 B2
(45) **Date of Patent: *Apr. 10, 2012**

(54) POWER CONNECTOR HAVING PROTECTIVE INTERIOR COVER

(75) Inventors: Min Chul Kim, Santa Clara, CA (US); Paul Yuan, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/213,080

(22) Filed: Aug. 18, 2011

(65) Prior Publication Data

US 2011/0300754 A1 Dec. 8, 2011

Related U.S. Application Data

(63) Continuation of application No. 12/916,480, filed on Oct. 29, 2010, now Pat. No. 8,011,975.

(60) Provisional application No. 61/349,187, filed on May 27, 2000.

(51) Int. Cl.
*H01R 13/64* (2006.01)

(52) U.S. Cl. ..... 439/680

(58) Field of Classification Search ..... 439/680, 439/651, 934, 354, 677, 678, 732, 172, 170, 439/655

See application file for complete search history.

(56) References Cited

U.S. PATENT DOCUMENTS

| | | | | |
|---|---|---|---|---|
| 3,391,384 | A | 7/1968 | Hughes | |
| 4,067,634 | A | 1/1978 | Hoffman | |
| 5,907,197 | A | 5/1999 | Faulk | |
| 6,328,581 | B1 * | 12/2001 | Lee et al. | 439/106 |
| 6,492,590 | B1 * | 12/2002 | Cheng | 174/50 |
| 6,851,955 | B2 * | 2/2005 | Chen | 439/76.1 |
| 6,857,012 | B2 | 2/2005 | Sim et al. | |
| 6,957,012 | B2 * | 10/2005 | He et al. | 392/392 |
| 7,212,420 | B2 | 5/2007 | Liao | |
| 7,259,567 | B2 | 8/2007 | Sears et al. | |
| 7,344,385 | B2 | 3/2008 | Chen | |
| 7,824,211 | B1 | 11/2010 | Wu | |
| 2009/0289596 | A1 | 11/2009 | McGinley et al. | |
| 2011/0300754 | A1 * | 12/2011 | Kim et al. | 439/620.21 |

FOREIGN PATENT DOCUMENTS

GB 2 061 635 A 5/1981

* cited by examiner

*Primary Examiner* — Tulsidas C Patel
*Assistant Examiner* — Phuongchi Nguyen
(74) *Attorney, Agent, or Firm* — Kilpatrick Townsend and Stockton LLP

(57) ABSTRACT

Circuits, methods, and apparatus that may provide protection from exposed wires or terminals when a power plug is damaged or destroyed. One example may provide a plug having an inner cover that shields power carrying wires or terminals when an outer shell is damaged or destroyed. The inner cover may include openings to receive conductors, where the openings may lead to terminals or wires that connect to plug prongs. The received conductors may attach directly or indirectly to an outer shell, and further to a power cord, circuitry, or other electronic components. When the outer shell is damaged or destroyed, the conductors may pull out of the openings in the inner cover, thus disconnecting from the wires or terminals. The wires or terminals may thus remain protected by the inner shell, avoiding exposure to contact by users or inadvertent conductors.

19 Claims, 6 Drawing Sheets

POWER CONNECTOR HAVING PROTECTIVE INTERIOR COVER

This application is a continuation of U.S. patent Ser. No. 12/916,480, filed Oct. 29, 2010, now U.S. Pat. No. 8,011,975, and claims the benefit of U.S. provisional application No. 61/349,187, filed May 27, 2010, which are all incorporated by reference.

BACKGROUND

Electronic devices often receive power from a wall outlet, car power outlet, or other such source. For example, a power plug may include two or more prongs that fit into openings in a wall outlet. The prongs of the plug may connect to conductors in a cord that connects to the electronic device. Power may thus be provided from the wall outlet to the electronic device.

Wall outlets may provide different voltages depending on geographical region. For example, in the United States, the power supplied by a wall outlet is 110 Volts AC. In the United Kingdom it is 220 Volts AC.

Often, an electronic device may need to be powered by a DC voltage instead of an AC voltage. Circuitry such as transformers may be used to convert the AC voltage to a DC voltage, which can then be provided to the electronic device. This circuitry can be located in a unit, often referred to as a brick, located either between the plug and the electronic device, or attached as part of the plug.

These plugs may on occasion be kicked, bumped into, or otherwise struck such that they may become damaged. This is perhaps more likely when circuitry such as a power transformer is included in housing attached to the plug, since the housing itself may be struck causing damage to the attached plug. Also, cords attached to the plugs may be pulled such that damage to the plug may result. In such cases, the damage may expose wires or terminals that are carrying the power supplied by the wall outlet.

Having these wires or terminals exposed may cause various problems. For example, a user may try to unplug a damaged plug. In so doing, the user may make contact with the exposed wires or terminals, which may lead to the user being shocked or electrocuted. Also, the exposed wires or terminals may be shorted by a conductive object, thereby leading to large current flows between the wires or terminals. This in turn may lead to fire or other heat related damage to the wall outlet, conductive object, and surrounding area.

Thus, what is needed are circuits, methods, and apparatus that provide protection from exposed wires or terminals when a plug is damaged or destroyed.

SUMMARY

Accordingly, embodiments of the present invention may provide circuits, methods, and apparatus that may provide protection from exposed wires or terminals when a plug is damaged or destroyed. An illustrative embodiment of the present invention may provide a plug having an inner cover. The inner cover may shield and thus provide protection from wires or terminals that may be carrying power supplied by a wall outlet, car power outlet, or other power source, when an outer shell of a power plug is damaged or destroyed.

An illustrative embodiment of the present invention may provide one or more prongs or other conductors that may mate with one or more openings on a power outlet, and may thus receive power from the outlet. An inner cover may shield one or more wires or terminals that may carry the power from the outlet. The inner shield may include openings to receive conductors. These openings may lead to the terminals or wires, which connect to the prongs. The received conductors may attach directly or indirectly to an outer shell, and further to a power cord, circuitry, or other electronic components. If the outer shell is damaged or destroyed, the conductors may disconnect from the wires or terminals. The wires or terminals may thus remain protected by the inner shell, avoiding exposure to contact by users or inadvertently conducting objects.

A specific embodiment of the present invention may provide a power plug having a bottom plate that may be connected to a number of prongs. The prongs may be connected to wires or terminals. The wires or terminals may be covered by an inner cover. The inner cover may include one or more openings leading to the wires or terminals. The inner cover may be covered by an outer shell. The outer shell may include conductors that fit in the one or more openings, where the conductors form electrical connections with the wires or terminals. The outer shell may instead mate with another plug portion or clip, which may include conductors that fit in the one or more openings, where the conductors may form electrical connections with the wires or terminals. The power plug may also include a fuse in series with a wire or terminal to protect an electronic device powered via the plug from damage due to transient overvoltage conditions at a power outlet.

Various embodiments of the present invention may incorporate one or more of these and the other features described herein. A better understanding of the nature and advantages of the present invention may be gained by reference to the following detailed description and the accompanying drawings.

BRIEF DESCRIPTIONS OF THE DRAWINGS

DESCRIPTION OF ILLUSTRATIVE EMBODIMENTS

Figure 1:
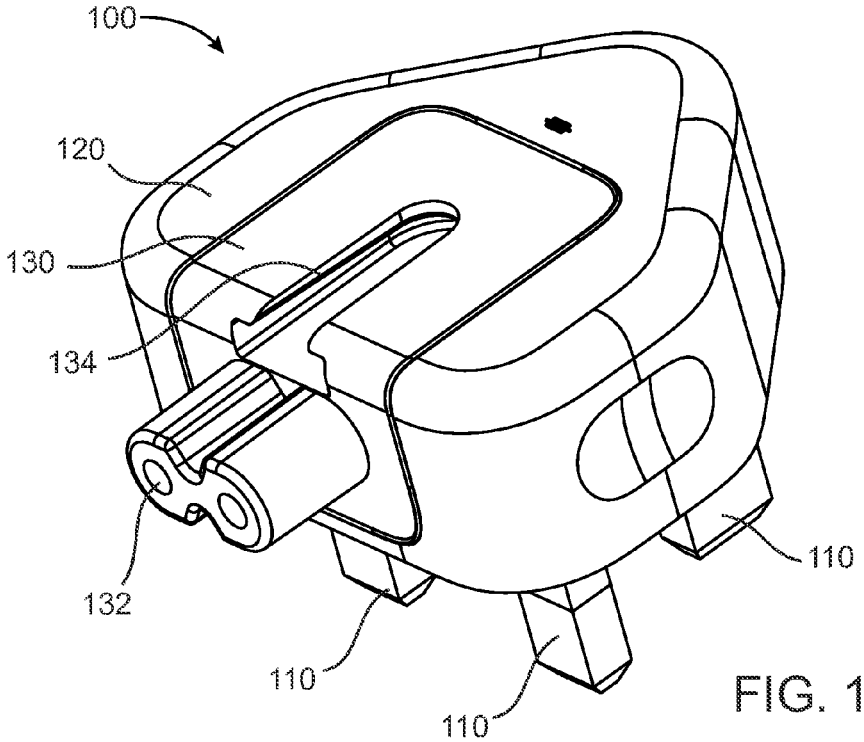
FIG. 1 illustrates a top oblique view of a power plug consistent with a specific embodiment of the present invention.

FIG. 1 illustrates a top oblique view of a power plug consistent with a specific embodiment of the present invention. This figure, as with the other included figures, is shown for illustrative purposes only and does not limit either the possible embodiments of the present invention or the claims.

Power plug 100 may include a number of prongs 110. Prongs 110 may be arranged to fit in a power outlet, such as a wall socket. Power received at prongs 110 may be provided at terminals 132. Prongs 110 may be arranged to receive power from outlets commonly available in various countries or regions. For example, prongs 110 may be arranged to fit in outlets in the United Kingdom, the United States, China, or other country or region. Alternately, prongs 110 may be arranged to fit in less common or proprietary outlets.

Terminals 132 may be attached to clip 130. Clip 130 may include a slot 134. Housings external to plug 100 may be attached by inserting a tab into slot 134. Circuitry in the housing may be powered by power provided at terminals 132. Clip 130 may be fixed to outer shell 120. In various embodiments of the present invention, clip 130 and outer shell 120 may be formed as a single piece.

Figure 2:
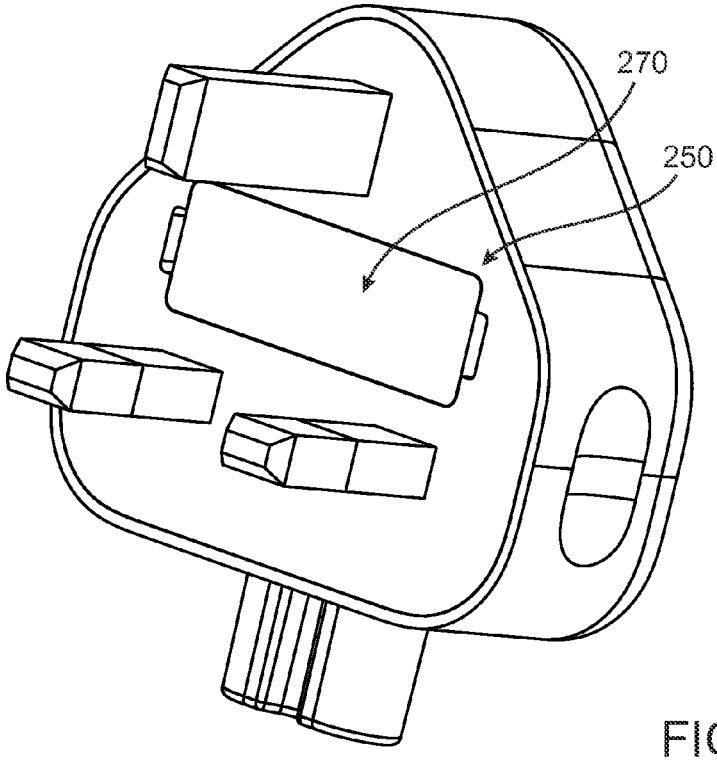
FIG. 2 illustrates a bottom oblique view of a power plug consistent with an embodiment of the present invention.

FIG. 2 illustrates a bottom oblique view of a power plug consistent with an embodiment of the present invention. This view illustrates bottom plate 250 and fuse cover 270. Fuse cover 270 may cover a fuse (not shown) that is electrically in series between one or more prongs 110 and one or more terminals 132. This fuse may protect circuitry coupled to power plug 100 from transient overvoltage conditions.

Figure 3:
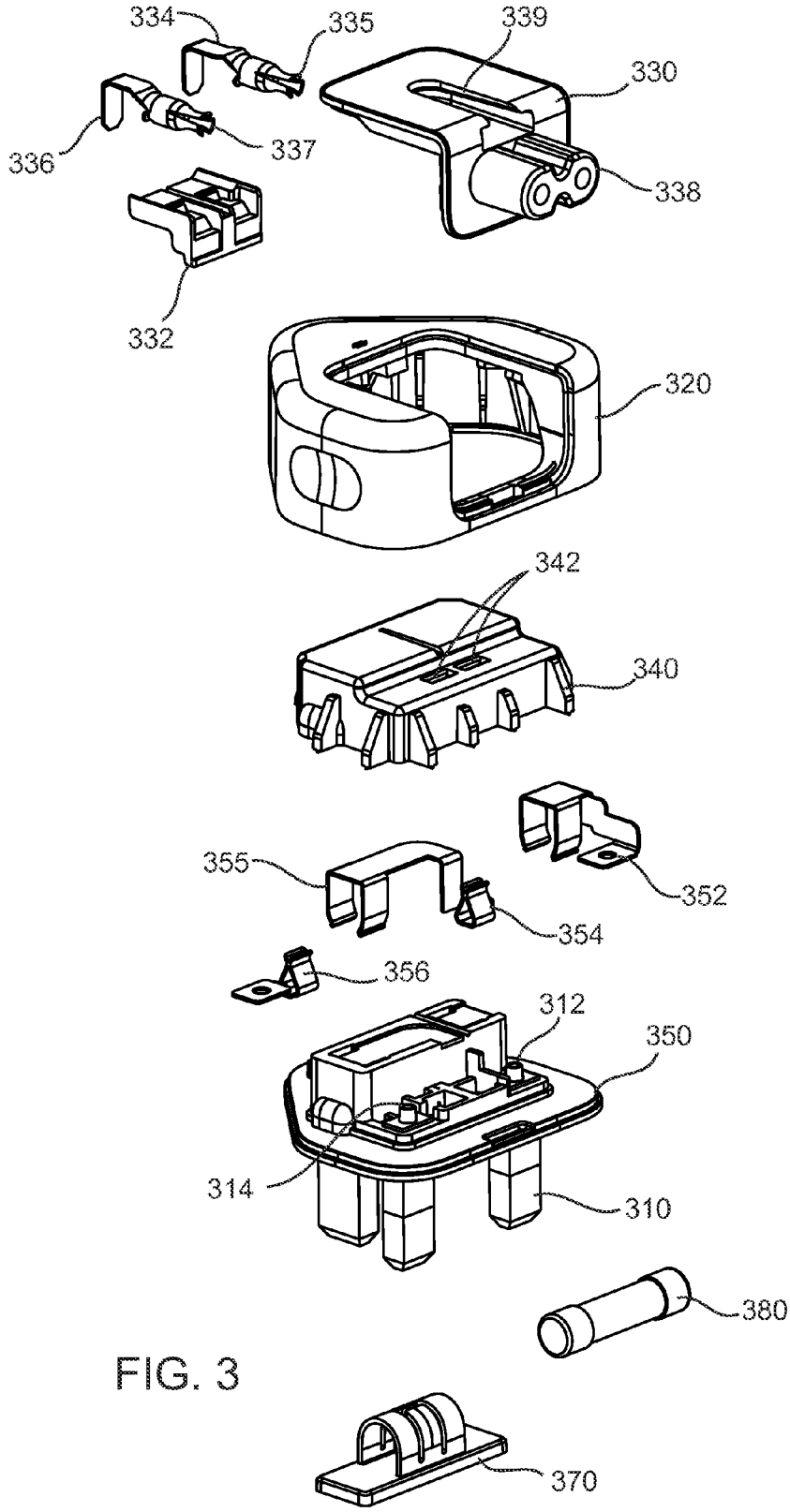
FIG. 3 illustrates an exploded view of a power plug consistent with an embodiment of the present invention.

FIG. 3 illustrates an exploded view of a power plug consistent with an embodiment of the present invention. This figure includes a bottom plate 350, which may be attached to a number of prongs 310. Again, prongs 310 may be arranged to fit in openings in a power outlet, such as a wall socket. Terminals 354 and 356 may attach to bottom plate 350. Terminal 354 and fuse holder 352 may electrically connect to terminals of fuse 380.

Inner cover 340 may be fixed to bottom plate 350 to protect terminals 354 and 356. Outer shell 320 may be fixed to bottom plate 350 to cover inner shell 340. Conductors 334 and 336 may attach to clip 330 and may be held in place by piece 332. Conductors 334 and 336 may form an electrical connection between terminals 338 and terminals 354 and 356. Specifically, portions 335 and 337 of conductors 334 and 336 may be available at terminals 338. Tabbed ends of conductors 334 and 336 may fit through openings 342 in inner cover 340 and make contact with terminals 354 and 356. In this way, an electrical pathway from terminals 338 through conductors 334 and 336 to terminals 354 and 356, ending at prongs 310 may be formed. Fuse holder 370 may hold fuse 380 in the bottom portion of bottom plate 350.

Again, an external housing may attach to the power plug. In one example, the housing includes a tab to fit into slot 339. The housing may further include terminals to receive power from conductors 334 and 336 in terminals 338. The housing may include circuitry such as AC-to-DC and DC-to-DC power conversion, including transformers and capacitors, wired or wireless transceivers, or other power, networking, or other circuitry.

This arrangement may provide a power plug where inner cover 340 protects terminals 354 and 356 from exposure when outer shell 320 is damaged or destroyed. Again, this is particularly likely when a housing (not shown) is attached to clip 330, though it is not limited to these instances. Such a housing may protrude from a wall outlet and be relatively large. For this reason, the housing may be vulnerable to being struck by persons or equipment. Such contact may damage or destroy some or all of the outer shell 320. In this event, inner cover 340 may remain intact, protecting terminals 354 and 356. This reduces or eliminates the chance of accidental contact of voltages on these terminals by people or other objects, thereby reducing the chances of injury or property damage.

A power plug according to an embodiment of the present invention may be assembled as follows. Terminal 356 may attach to contact 314 on bottom plate 350. Fuse holder 352 may attach to contact 312. Terminal 354 may attach to bottom plate 350. Contacts 312 and 314 may each connect to a prong 310. Terminal 354 may be attached to fuse holder contact 355. Fuse holder contact 352 may be attached to bottom plate 350. In this way, fuse holders 355 and 352 may be made available under base plate 350. Fuse 380 may be inserted into fuse holders 355 and 352, and covered by fuse cover 370.

Inner cover 340 may be attached to bottom plate 350, thereby covering contacts 354 and 356 and protecting them from exposure in the event of damage to the power plug. Outer shell 320 may attach to bottom plate 350.

Again, conductors 334 and 336 may fit under clip 330 and be held in place by piece 332, while ends 335 and 337 of conductors 334 and 336 may be inserted in terminals 338 of clip 300. Tab ends of conductors 334 and 336 may fit in openings 342 in inner cover 340 to make contact with terminals 354 and 356. Clip 330 may be attached to outer shell 320. In other embodiments, clip 330 and outer shell 320 may be formed as a single piece. A housing (not shown) may attach to the plug by using a tab inserted into slot 339. Terminals 338 may also be used to provide mechanical support for the housing. Power available at terminals 338 may be used to power circuitry in the housing, or the power available at terminals 338 may be converted by circuitry in the housing.

In various embodiments of the present invention, the shell portions of the power plug may be plastic or other insulative material, while the conductive portions may be aluminum, steel, copper, or other conductive material. For example, clip 330, outer shell 320, inner cover 340, and base plate 350 may be plastic or other nonconductive material. Part or all of prongs 310 may be conductive material. Terminals 354 and 356, as well as fuse holders 352 and 355 and conductors 334 and 336, may be formed using a conductive material.

Figure 4:
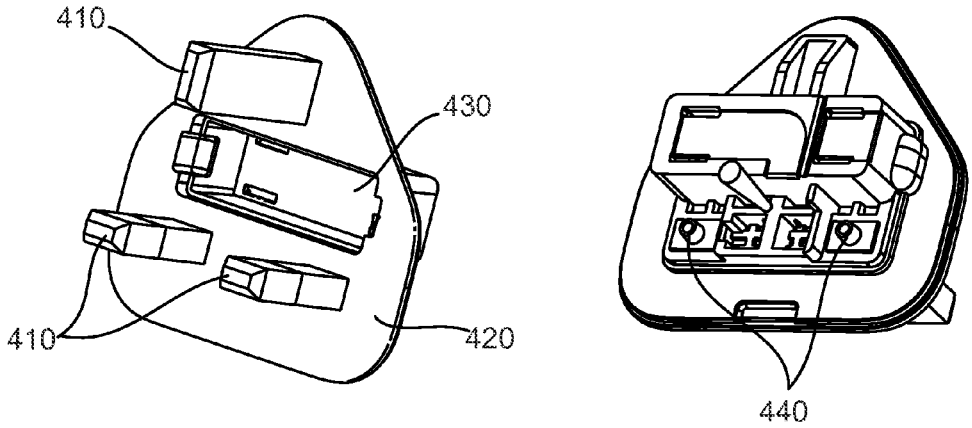
FIG. 4 illustrates a bottom plate consistent with an embodiment of the present invention.

FIG. 4 illustrates a bottom plate consistent with an embodiment of the present invention. A number of prongs 410 may be attached to bottom plate 420. Bottom plate 420 may include a recess or cavity 430 that may hold a fuse. Prongs 410 may be electrically connected to contacts 440 on the top side of bottom plate 420. Terminals, for example terminals 354 and 356 in FIG. 3, may be attached to contacts 440.

Figure 5:
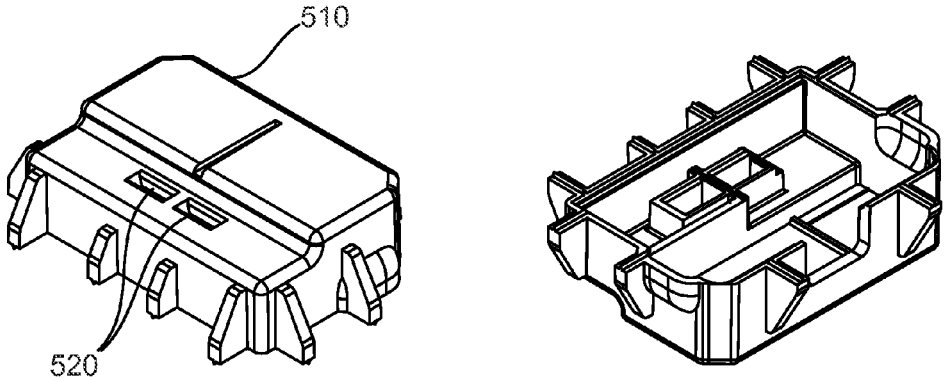
FIG. 5 illustrates an inner cover consistent with an embodiment of the present invention.

FIG. 5 illustrates an inner cover 510 consistent with an embodiment of the present invention. Inner cover 510 may be fixed to bottom plate 420 in FIG. 4. Inner cover 510 may include openings 520. Openings 520 allow electrical contact to be made with terminals fixed to contacts 440.

Figure 6:
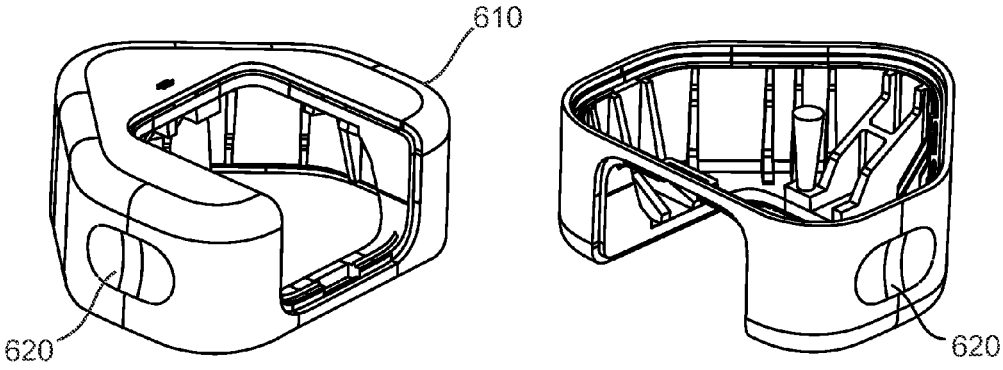
FIG. 6 illustrates an outer shell consistent with an embodiment of the present invention.

FIG. 6 illustrates an outer shell 610 that is consistent with an embodiment of the present invention. Outer shell 610 may include recessed portion 620. Recessed portion 620 provides a grip for a user to extract the power plug from a wall outlet or other power source.

Outer shell 610 may cover inner cover 510 shown in FIG. 5. In this way, if outer shell 610 is damaged or destroyed, the inner cover 510 may remain intact protecting the terminals attached to prongs 410. In this way, even when the power plug is damaged or destroyed, voltages received at prongs 410 are not exposed to contact with a user or other object.

Figure 7:
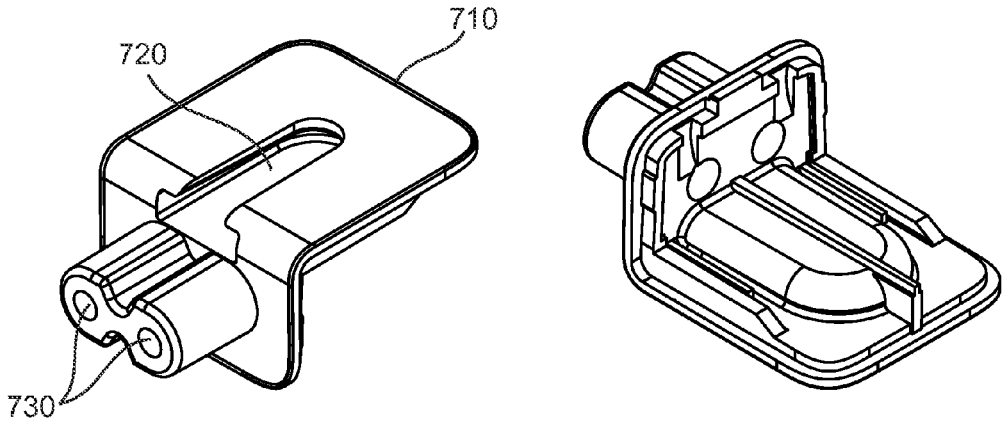
FIG. 7 illustrates a clip consistent with an embodiment of the present invention.

FIG. 7 illustrates a clip consistent with an embodiment of the present invention. Clip 710 includes terminals 730 and slot 720. Again, an external housing may include a tab to fit in slot 720, thereby holding the housing in place. Terminals 730 may also provide mechanical support for the housing. Power available at terminals 730 may be used or converted by circuitry inside the housing. The housing may include circuitry for AC-to-DC power conversion, such as transformers, capacitors, and other circuitry. In other an embodiments of the present invention, the housing may include other circuitry, such as wireless transceivers, USB power or hub circuits, or other networking or other power-related circuitry. In one embodiment of the present invention, power is made available at a USB receptacle attached to the housing.

Figure 8:
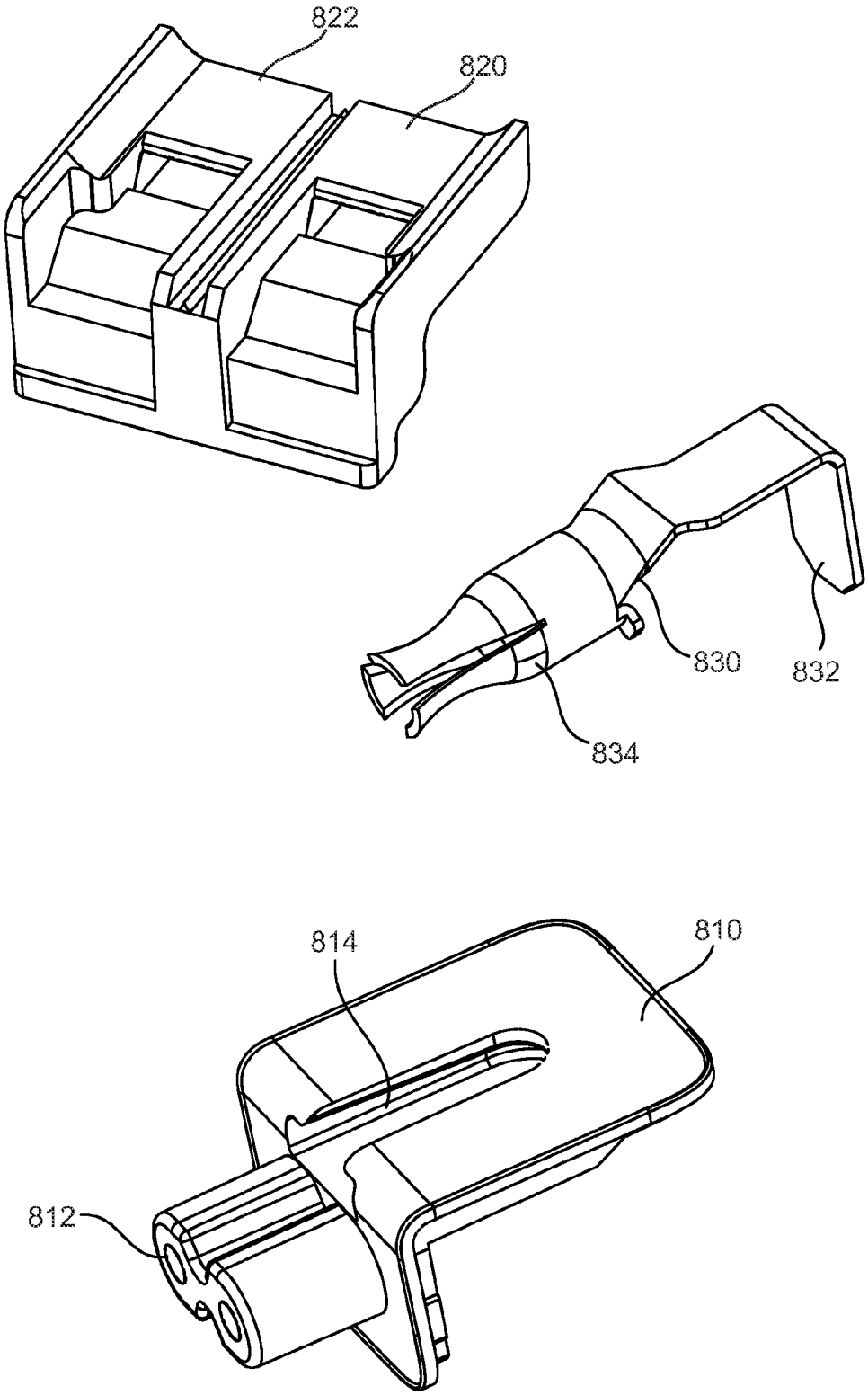
FIG. 8 illustrates portions of a clip consistent with an embodiment of the present invention.

FIG. 8 illustrates portions of a clip consistent with an embodiment of the present invention. Conductors 830 may include tabbed end 832. Two conductors 830 may fit with piece 820 such that tabbed ends 832 fold over edge 822. Tabbed ends 832 may fit in openings 512 in inner cover 520. Piece 820 may fit under clip 810. Ends 834 of conductors 830 may fit in openings in terminals 812. Clip 810 and piece 820 may be formed of plastic or other nonconductive material, while conductors 830 may be made of a conductive material.

Figure 9:
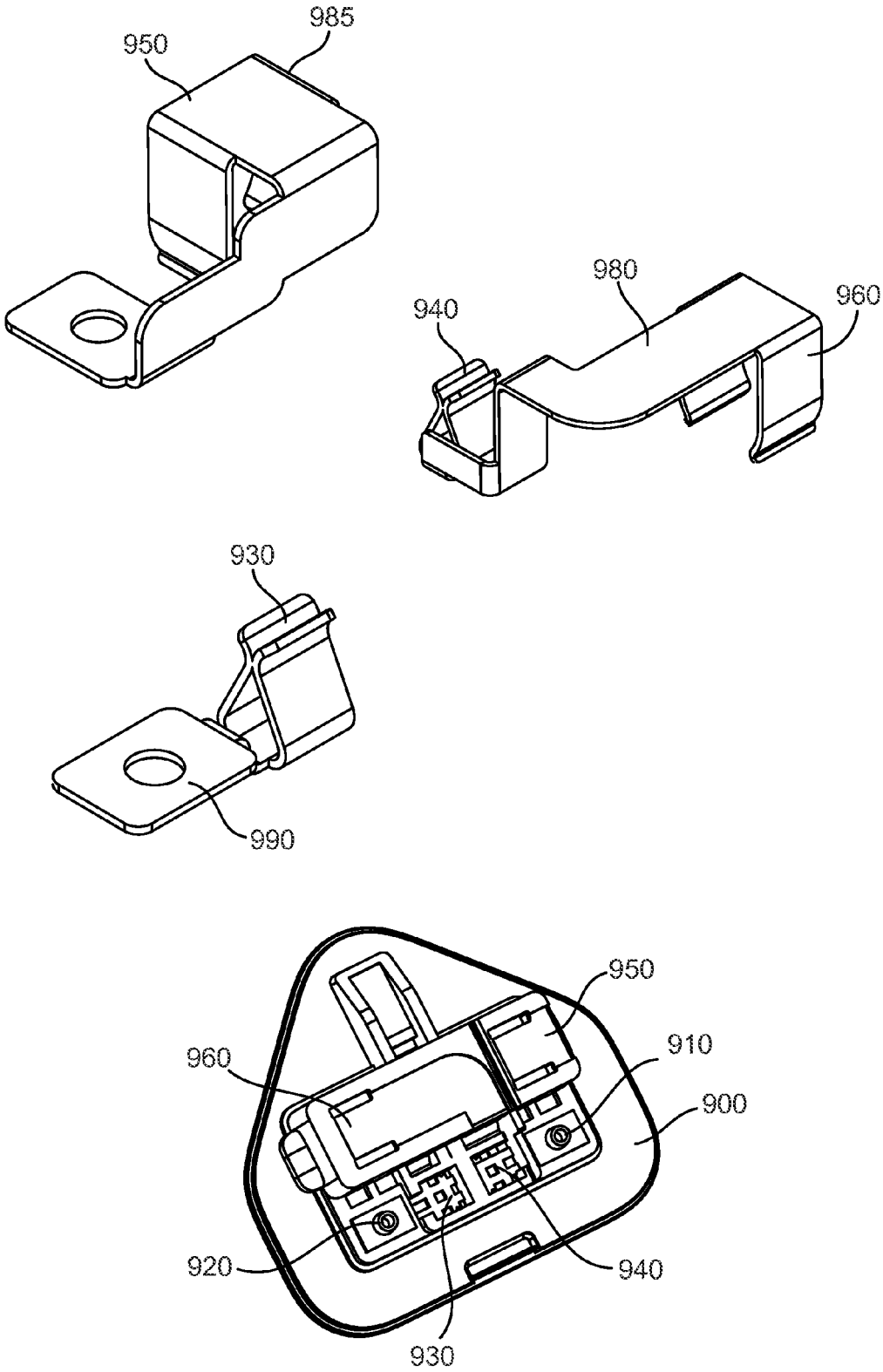
FIG. 9 illustrates portions of a bottom plate consistent with an embodiment of the present invention.

FIG. 9 illustrates portions of a bottom plate consistent with an embodiment of the present invention. Plate 900 may include terminals 910 and 920, which may connect to prongs underneath bottom plate 900. Fuse holder 985 may be attached to contact 910. Terminal 990 may connect to contact 920 and may provide a terminal portion 930. When the plug is assembled, terminal portion 930 mates with a tabbed end 832 of conductor 830.

A fuse may form an electrical connection between fuse holder 950 and fuse holder 960. Piece 980 includes fuse holder 960 and provides a terminal 940 that may mate with tabbed end 832 of conductor 830.

In this way, a first prong (underneath bottom plate 900 and not shown) may connect to contact 910. Contact 910 may connect to fuse holder 950 with piece 985. A fuse (not shown) may continue the electrical path to fuse holder 960. Piece 980 may tie fuse holder 960 to terminal 940. A second prong (also underneath bottom plate 900 and not shown) may connect to contact 920. Piece 990 may provide a path from contact 920 to terminal 930.

Terminals 930 and 940 may align with openings 520 in inner cover 510. Tabbed ends 832 of conductors 830 may fit through openings 520 in inner cover 510 and fit in terminals 930 and 940. In this way, if an outer shell 620 is damaged or destroyed, or clip 810 is pulled away from outer shell 620, conductors 830 may pull out of openings 520 in inner cover 510 and thus out of terminals 930 and 940. This may leave inner cover 510 intact to protect terminals 930 and 940 from exposure.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A power plug comprising:
a bottom plate;
a plurality of prongs fixed to the bottom plate;
a plurality of terminals electrically connected to the plurality of prongs, wherein at least one of the plurality of terminals is in direct physical contact with at least one of the plurality of prongs;
an inner cover fixed to the bottom plate and covering the plurality of terminals, the inner cover having a plurality of openings;
an outer shell attached to the bottom plate and covering the inner cover; and
a plurality of conductors attached to the outer shell, each conductor to fit in one of the plurality of openings in the inner cover to form an electrical connection with one of the plurality of terminals.

2. The power plug of claim 1 further comprising:
a fuse holder to fit in an opening a bottom of the bottom plate, and to hold a fuse in series between one of the plurality of prongs and one of the plurality of terminals.

3. The power plug of claim 1 further comprising:
a fuse in series between one of the plurality of prongs and one of the plurality of terminals.

4. The power plug of claim 1 further comprising:
circuitry enclosed in the outer shell to convert AC power to DC power.

5. The power plug of claim 1 wherein the plurality of prongs are arranged to fit in a wall-outlet commonly found in the United Kingdom.

6. The power plug of claim 1 wherein when the outer shell is damaged or destroyed, the plurality of terminals may remain protected by the inner cover.

7. A power plug comprising:
a bottom plate;
a plurality of prongs fixed to the bottom plate;
a plurality of terminals electrically connected to the plurality of prongs;
an inner cover fixed to the bottom plate and covering the plurality of terminals, the inner cover having a plurality of openings;
an outer shell attached to the bottom plate and covering the inner cover;
a clip attached to the outer shell; and
a plurality of conductors attached to the clip, each conductor to fit in an opening in the inner cover to form an electrical connection with one of the plurality of terminals.

8. The power plug of claim 7 further comprising:
a fuse in series between one of the plurality of prongs and one of the plurality of terminals.

9. The power plug of claim 7 wherein the plurality of prongs are arranged to fit in a wall-outlet commonly found in the United Kingdom.

10. The power plug of claim 7 further comprising:
a housing attached to the clip.

11. The power plug of claim 10 further comprising:
circuitry enclosed in the housing to convert AC power to DC power.

12. The power plug of claim 10 further comprising:
a wireless transceiver enclosed in the housing.

13. A power plug comprising:
an outer housing attached to a plurality of prongs;
an inner housing having a plurality of openings;
a plurality of terminals, each coupled to one of the plurality of prongs and covered by the inner housing; and
a plurality of conductors attached to the outer housing and each having a first end to fit in one of the plurality of openings of the inner housing to contact one of the plurality of terminals such that an electrical connection between each of the conductors and a prong is formed, each of the plurality of conductors having a second end to electrically connect to a power cord.

14. The power plug of claim 13 wherein the plurality of prongs are arranged to fit in a wall-outlet commonly found in the United Kingdom.

15. The power plug of claim 13 wherein when the outer housing is damaged or destroyed, the plurality of terminals may remain protected by the inner housing.

16. The power plug of claim 13 further comprising:
a fuse in series between one of the plurality of prongs and one of the plurality of terminals.

17. The power plug of claim 13 further comprising a clip attached to the outer shell, wherein the plurality of conductors are attached to the clip.

18. The power plug of claim 17 further comprising:
a housing attached to the clip.

19. The power plug of claim 18 further comprising: circuitry enclosed in the housing to convert AC power to DC power.

* * * * *